US006217500B1

(12) United States Patent
Helseth et al.

(10) Patent No.: US 6,217,500 B1
(45) Date of Patent: Apr. 17, 2001

(54) METHOD AND APPARATUS FOR DISPENSING TWIST-TIES

(75) Inventors: James Ray Helseth, Plymouth; Brian Ye, Brooklyn Center, both of MN (US)

(73) Assignee: Twist-Ease, Inc., Minneapolis, MN (US)

( * ) Notice: Subject to any disclaimer, the term of this patent is extended or adjusted under 35 U.S.C. 154(b) by 0 days.

(21) Appl. No.: 09/321,775

(22) Filed: May 27, 1999

Related U.S. Application Data

(63) Continuation-in-part of application No. 08/686,807, filed on Jul. 26, 1996, now Pat. No. 5,961,434.

(51) Int. Cl.[7] ..... B31D 1/00

(52) U.S. Cl. ..... 493/352; 493/962; 221/26

(58) Field of Search ..... 493/352, 372, 493/361–369, 962; 221/26; 312/128; 100/292; 206/338, 343, 820, 526

(56) References Cited

U.S. PATENT DOCUMENTS

| | | | | |
|---|---|---|---|---|
| D. 156,922 | | 1/1950 | Sonntag . | |
| D. 261,452 | | 10/1981 | Chandler . | |
| D. 285,719 | | 9/1986 | Conlon . | |
| D. 294,908 | | 3/1988 | Childress . | |
| D. 323,594 | | 2/1992 | Helseth . | |
| 628,642 | | 7/1899 | Wyman . | |
| 740,001 | | 9/1903 | Flanagin . | |
| 1,203,946 | * | 11/1916 | Westenhiser | 100/292 |
| 1,270,111 | * | 6/1918 | Brittain . | |
| 1,441,359 | | 1/1923 | Langston . | |
| 2,050,394 | | 8/1936 | Straubel . | |
| 2,144,263 | | 1/1939 | Lane . | |
| 2,277,265 | | 3/1942 | Zahniser . | |
| 2,973,597 | | 3/1961 | Powell . | |
| 2,984,161 | | 5/1961 | Cook et al. . | |
| 3,035,925 | | 5/1962 | Jackson . | |
| 3,068,135 | | 12/1962 | Bower . | |
| 3,207,564 | | 9/1965 | Patrick et al. . | |
| 3,290,854 | | 12/1966 | MacMurray . | |
| 3,409,948 | | 11/1968 | Goodwin . | |
| 3,420,723 | | 1/1969 | Thorp . | |
| 3,468,509 | | 9/1969 | Foltz . | |
| 3,756,453 | * | 9/1973 | Griffioen | 221/26 |
| 3,774,755 | | 11/1973 | Cast et al. . | |
| 3,783,931 | | 1/1974 | Assael . | |
| 3,995,886 | | 12/1976 | Staats . | |
| 4,052,886 | | 10/1977 | Buick . | |
| 4,184,218 | | 1/1980 | Hawkes . | |
| 4,281,854 | | 8/1981 | Savich . | |
| 4,509,231 | | 4/1985 | Paxton . | |
| 4,539,237 | | 9/1985 | Clayton . | |
| 4,543,862 | | 10/1985 | Levene et al. . | |

(List continued on next page.)

*Primary Examiner*—David T. Fidei
(74) *Attorney, Agent, or Firm*—Merchant & Gould P.C.

(57) ABSTRACT

A twist-tie cluster is described that includes a plurality of twist ties, each having a wire retained within a strip of material, wherein a cut is made in each of said wires between said first end and said second end, and where an uncut portion of the material connects the twist ties. A connecting means connects first segments of the twist ties together. A twist-tie dispenser is also described including a back wall and a cam member rotatable between a first position and a second position, where the second position traps the twist ties between the back wall and the cam member. A method of dispensing twist-ties is described including trapping a group of twist-ties between a cam member and a back wall.

15 Claims, 4 Drawing Sheets

| | | | | | | |
|---|---|---|---|---|---|---|
| 4,828,645 | 5/1989 | Van Bortel . | 5,213,400 | 5/1993 | Helseth . | |
| 4,923,351 | 5/1990 | Nishikawa . | 5,232,431 | 8/1993 | Helseth . | |
| 4,948,202 | 8/1990 | Helseth . | 5,412,912 | 5/1995 | Alves . | |
| 4,998,630 | 3/1991 | Schwartz . | 5,593,033 | 1/1997 | Kunreuther . | |
| 5,092,830 | 3/1992 | Helseth . | 5,961,434 * | 10/1999 | Helseth | 493/352 |
| 5,112,083 | 5/1992 | Morrone . | | | | |
| 5,119,968 | 6/1992 | Palmer . | | | | |

* cited by examiner

METHOD AND APPARATUS FOR DISPENSING TWIST-TIES

CROSS REFERENCE TO RELATED APPLICATIONS

This application is a continuation-in-part application of application Ser. No. 08/686,807, filed Jul. 26, 1996, now U.S. Pat. No. 5,961,434. Application Ser. No. 08/686,807 is incorporated herein by reference.

FIELD OF THE INVENTION

The present invention relates to twist-tie closure devices of the type which are often available in bulk quantities in grocery stores for the purpose, among others, of temporarily closing plastic bags containing produce, meat packages, baked goods, candies, etc.

BACKGROUND OF THE INVENTION

Twist-tie closure devices are well known in the art and widely available. They are relatively inexpensive to manufacture and easy to use. Methods of making and dispensing twist-tie closure devices are described in U.S. Pat. Nos. 5,092,830, 5,213,400, and 5,232,431. Although the methods and apparatus disclosed in these patents constitute advances in the art, additional improvements are beneficial. For example, improvements relating to the cost of manufacturing the dispensers and the effort required to keep the dispensers stocked would be useful.

SUMMARY OF THE INVENTION

The present invention provides a simple, cost effective, and reliable method and apparatus for packaging and dispensing bulk quantities of twist-tie closure devices in hygienic, organized, and spill-proof fashion. In a preferred embodiment, numerous twist-ties are secured together at one "common" end to form a cluster or bunch. Each of the twist-ties extends from this common end to an opposite "free" end. Each of the twist-ties includes a wire disposed within a strip of material which is typically paper or plastic. Each wire is severed a relatively short distance from the common end. However, at least a portion of the material is not completely severed—thereby allowing any one of the twist-ties to be removed from the cluster simply by pulling on the free end thereof with sufficient force to tear the material.

The cluster is preferably formed of several layers of twist-tie panels, wherein each panel includes two sheets of paper or plastic and a plurality of wires disposed therebetween and extending generally parallel to one another. Individual twist-ties are formed by making parallel cuts in the sheets between each of the wires and parallel thereto. Each cut extends from the free end of a respective twist-tie to a point proximate where the wire is severed.

Each panel includes a relatively small span of uncut sheets extending from the point proximate where the wires are severed to the common end. In this manner, approximately one thousand twist-ties may be presented for use within a space of only a few cubic inches. Many advantages of the present invention will become apparent from the description that follows.

A twist-tie dispenser is also described including a back wall and a cam member rotatable between a first position and a second position to trap a group of twist-ties between the back wall and the cam member. The dispenser may include opposing side walls supporting the cam member.

Further, the dispenser may include a front wall and/or a top wall. The dispenser may be used in combination with the twist-tie cluster of the present invention or the dispenser and cluster may be used independently.

BRIEF DESCRIPTION OF THE DRAWING

With reference to the Figures wherein like numerals represent like parts and assemblies throughout several views.

Figure 1:
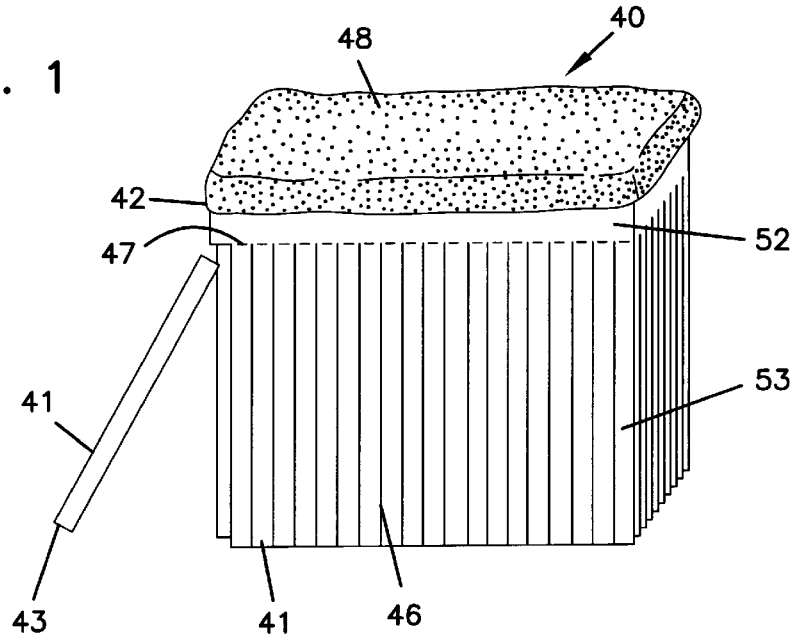
FIG. 1 is an metric view of a twist-tie cluster constructed according to the principles of the present invention.

While the invention is amenable to various modifications and alternative forms, specifics thereof have been shown by way of example in the drawings and will be described in detail. It should be understood however that the intention is not to limit the invention to the particular embodiments described. On the contrary, the invention is to cover all modifications, equivalents, and alternatives falling within the spirit and scope of the invention as defined by the appended claims.

DETAILED DESCRIPTION OF THE PREFERRED EMBODIMENT

Figure 8:
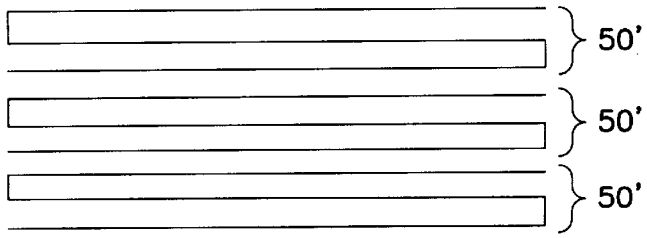
FIG. 8 is a diagrammatic top view of an alternative embodiment wherein a twist-tie cluster is comprised of several sheets each of which is folded back against itself.

In FIGS. 1–7, a preferred embodiment twist-tie cluster constructed according to the principles of the present invention is designated as 40, and a preferred embodiment twist-tie dispenser constructed according to the principles of the present invention is designated as 80. FIG. 8 illustrates an alternative embodiment of cluster 40.

Figure 3:
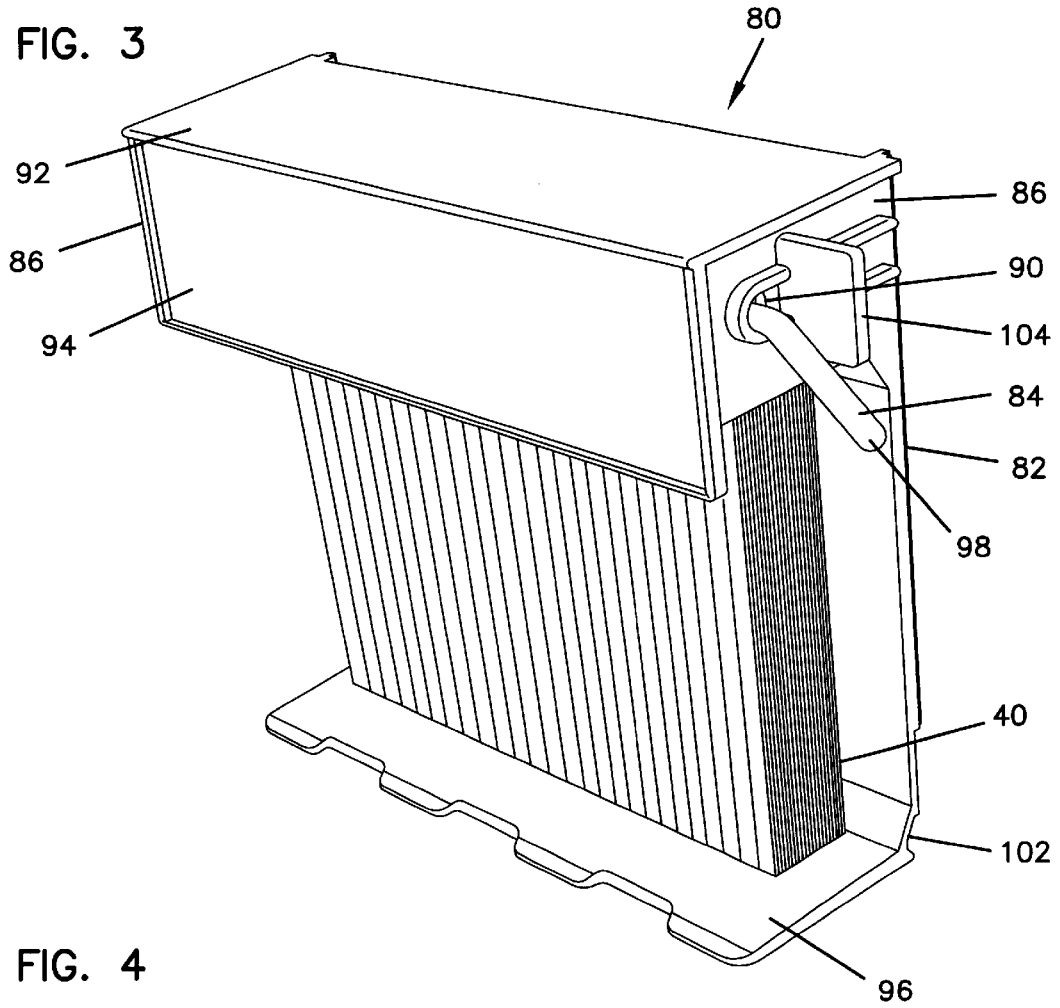
FIG. 3 is an isometric view of a twist-tie dispenser constructed according to the principles of the present invention holding a twist-tie cluster constructed according to the principles of the present invention.

In FIG. 3, the twist-tie cluster 40 is shown supported by the twist-tie dispenser 80. This particular combination is considered well suited for use in the produce section of a grocery store. Those skilled in the art will recognize that the present invention is not necessarily limited to a single application nor to the combination of the preferred embodiment twist-tie cluster 40 and the preferred embodiment twist-tie dispenser 80, since each may have utility in the absence of the other.

Figure 2:
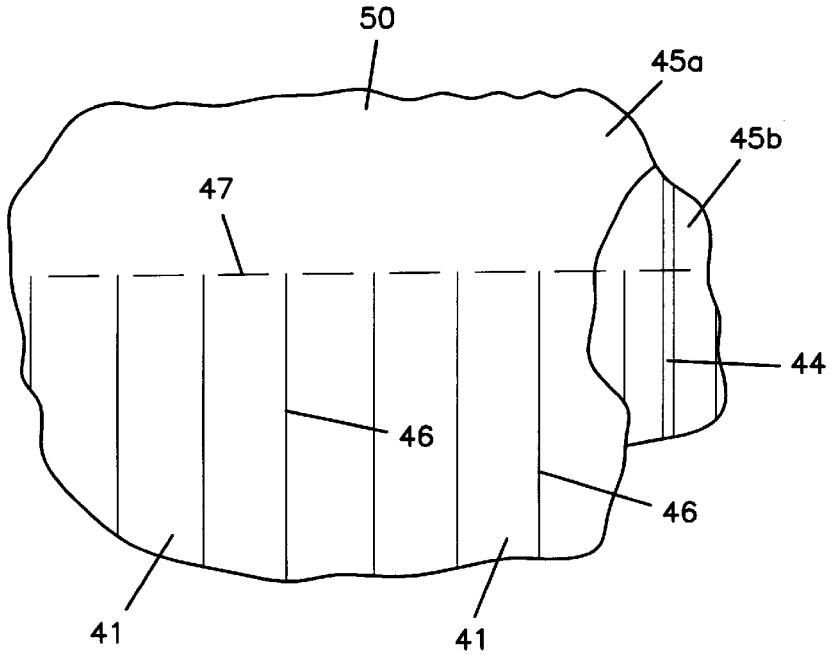
FIG. 2 is an enlarged front view of a portion of the twist-tie cluster of FIG. 1.

The twist-tie cluster 40 is shown in greater detail in FIGS. 1–2. The twist-tie cluster 40 includes a plurality of individual twist-ties 41, each of which extends from a first or common end 42 to a second or distal end 43. As shown in FIG. 2, each individual twist-tie 41 includes a wire 44 disposed or embedded within a carrier material, which in this case, includes two strips of paper 45*a* and 45*b*. Those skilled in the art will recognize that the proportions of the twist-tie cluster 40 may vary greatly according to the present invention. For example, longer or shorter twist-ties may be desired for specific applications. Longer twist-ties with a large paper area may be used where it is desirable to allow space for writing on the twist-tie. For a typical twist-tie used to close plastic bags, the detachable portion of the twist-tie may have a length of about four inches and a width of about one-eighth inch. For this type of twist-tie, the cluster may have dimensions of about 4.75 inches high, 4.75 inches wide, an about 0.75 inch deep in one possible embodiment.

In the preferred embodiment, the twist-ties 41 are provided in sheets 50, each of which includes the two strips of paper 45*a* and 45*b* and a plurality of the wires 44 extending parallel to one another. The individual twist-ties 41 are formed by cutting through the paper 45*a* and 45*b* along lines 46 which are generally spaced between and parallel to the wires 44. Each sheet 50 is then subjected to an intermittent, transverse cut along a line 47 extending perpendicular to the lines 46 and proximate the common ends 42 of the twist-ties 41. The so-called "intermittent" cut severs each of the wires 44 but leaves a portion of the papers 45*a* and 45*b* intact. A first segment 52 of the twist-tie 41 is disposed above the cut line 46, and a second segment 53 of the twist-tie 41 is disposed below the cut line 46. As a result of this process, the first or upper segment 52 of each individual twist-tie 41 remains interconnected (e.g., by way of papers 45*a* and 45*b* which remain uncut), but the second or lower segment 53 can be easily torn from the sheet 50. A method and apparatus for cutting the twist-tie sheets 50 in this manner is disclosed in U.S. Pat. No. 5,232,431.

Several sized sheets 50 may be positioned adjacent one another to form a cluster 40. Alternatively, a single sheet 50' may be folded back against itself at (e.g., approximately five inches) intervals to form the cluster 40 (best seen in FIG. 8). A cluster 40 as used herein is defined as a collection of twist-ties 41 at least three across and at least three deep.

In order to interconnect the sheets 50 of twist-ties into a cluster 40, the sheets 50 of twist-ties are clamped or held together in the region of the transverse cut 47, and the first ends 42 thereof are interconnected. In the preferred embodiment, the means for interconnecting the common ends 42 of the twist-ties is a suitable adhesive 48 which is applied thereto. Those skilled in the art will recognize alternatives (e.g., such as staples). In any case, the "weak link" in this arrangement is the transverse cut 47, which allows the lower segment 53 of each twist-tie 41 to be removed from the cluster 40 by a user upon grasping the free end of the twist-tie 41 and imparting a detaching force.

One preferred method for inter-connecting the common ends 42 of the twist-ties is to apply adhesive by dipping the common end 42 of a tightly clamped cluster of twist-tie sheets 50 into a pool of hot melt adhesive. The end of the cluster is then removed from the adhesive and excess adhesive is allowed to drip off. One possible type of hot melt adhesive that may be used is Nacan Cool Lock Food Packaging Adhesive KHM-416, made by the National Starch & Chemical Company of Rampton, Ontario.

Figure 6:
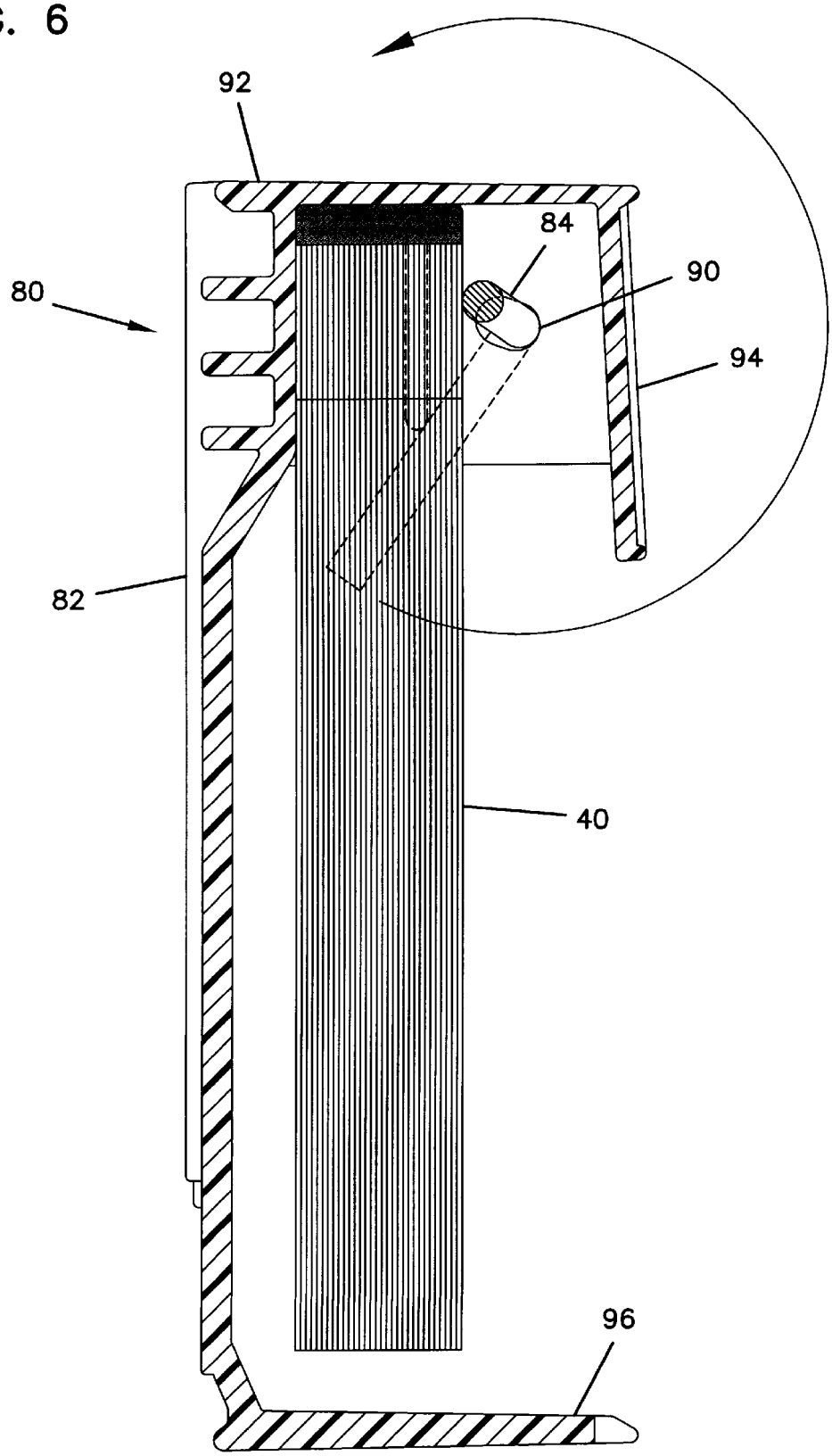
FIG. 6 is a cross-sectional view of the twist-tie dispenser of FIG. 1 where the cam member is in a closed position.
Figure 7:
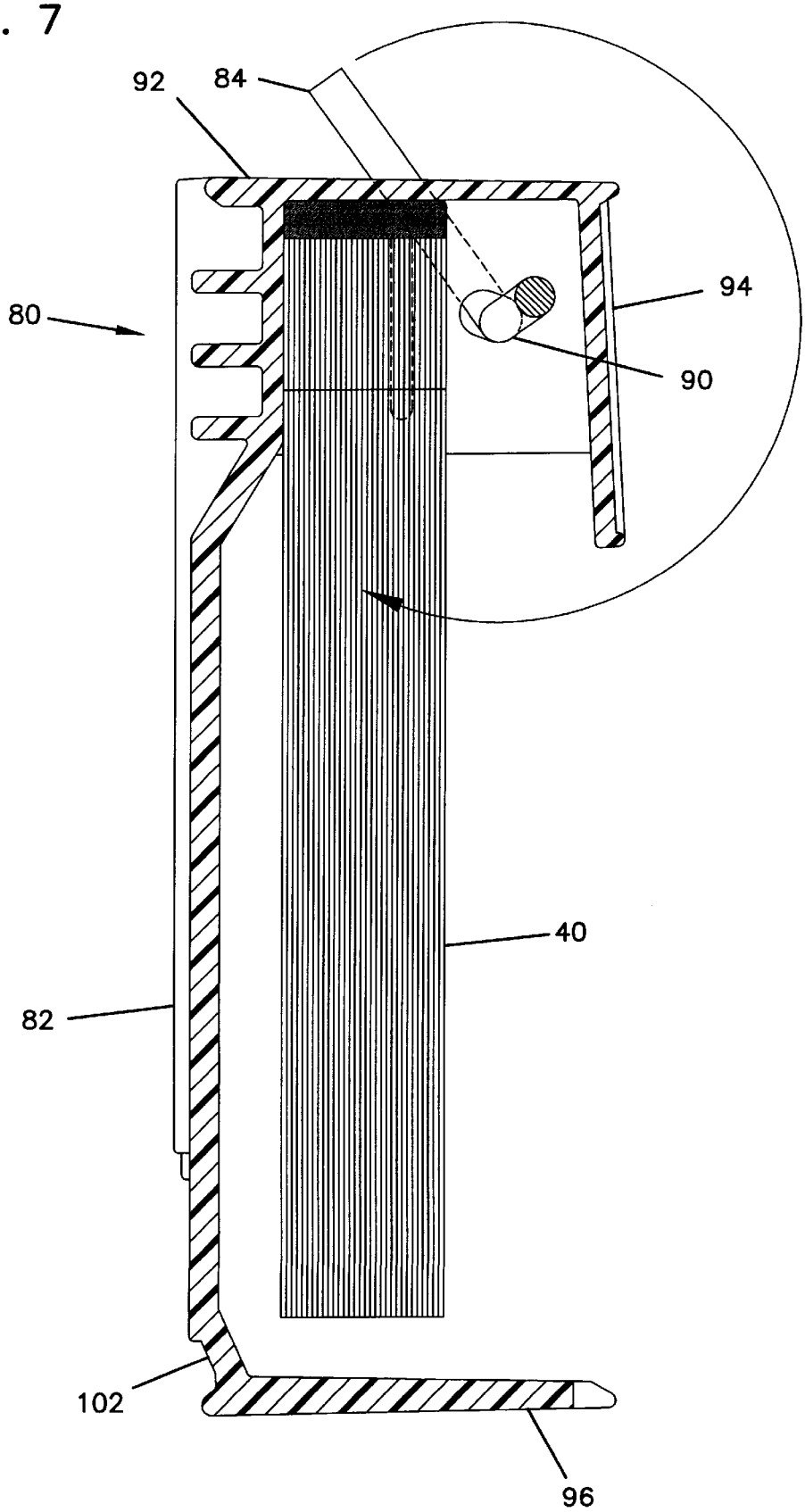
FIG. 7 is a cross-sectional view of the twist-tie dispenser of FIG. 1 where the cam member is in an open position.

A preferred twist-tie dispenser 80 is shown in FIGS. 3, 6 and 7. The twist-tie dispenser 80 is preferably plastic and is preferably made by an injection molding process, although many other manufacturing methods are possible and contemplated, such as extrusion.

The twist-tie dispenser 80 includes a back wall 82 and a cam member 84, where the cam member 84 traps the twist-tie cluster 40 against the back wall 82. The twist-tie dispenser 80 can also optionally include two side walls 86 having holes 90. The cam member 84 can extend between the side walls 86 and can be supported in the holes 90. In the alternative, other methods for supporting the cam member 84 can be used, such as a bracket extending from the back wall or top wall. Other cam member support devices may be used as long as they allow rotation of the cam member and allow insertion of the twist-tie cluster between the cam member and the back wall. The dispenser 80 can also include a top wall 92, a front wall 94 and a bottom wall 96.

The cam member 84 rotates between a first position, or open position, and a second position, or closed position. The cam member 84 is shown removed from the dispenser in FIGS. 4 and 5. The cam member 84 includes a lever portion 98 at one end that is grasped when rotating the cam member 84. At the other end, the cam member 84 may include an end cap to prevent the cam member 84 from slipping out of the hole 90. The cam member 84 also includes a trap portion 100 that is offset from the rest of the cam member, so that when the cam member is rotated using the lever portion 98, the trap portion 100 moves closer to the back wall to trap the twist-tie cluster 40 against the back wall 82.

The cam member 84 can be rotated between an open position (shown in FIG. 7) and a closed position (shown in FIG. 6.) In the open position, a first distance is defined between the trap portion of the cam member and the back wall that is large enough to allow the connecting end of the twist-tie cluster 40 to be easily inserted and removed from the space. After inserting the connected or common end 42 of the twist-ties into the space, the cam member 84 is rotated to trap the twist-ties between the trap portion 100 and the back wall 82. In the second position, a second distance between the cam member 84 and the back wall 82 that is smaller than the first distance. The dispenser 80 is designed so that the second distance is slightly smaller than the normal depth of the cluster 40, so that the cluster 40 is held tightly against the back wall 82 by the cam member 84. In the second or closed position, the cam member can rest against a stop 104 that extends from the side wall 86.

Figure 4:
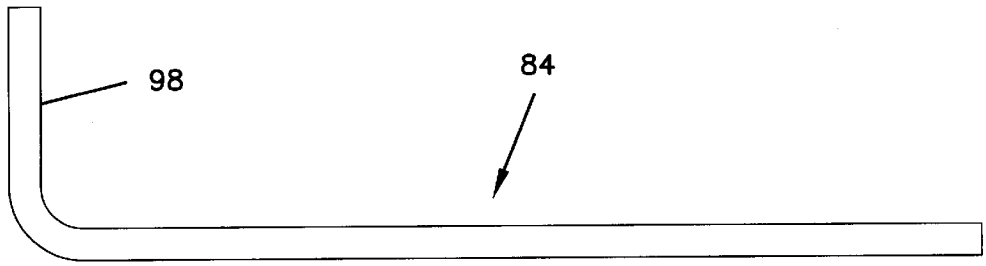
FIG. 4 is a top view of a cam member of the twist-tie dispenser of FIG. 1.
Figure 5:
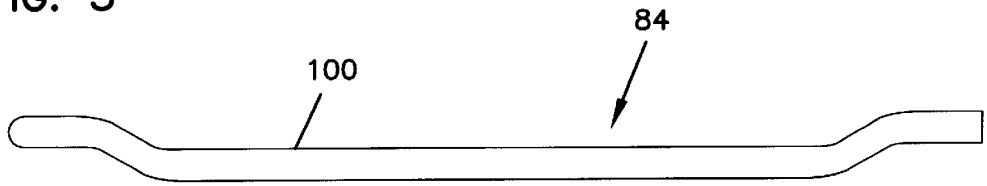
FIG. 5 is a view of the cam member of FIG. 4.

The cam member shown in FIGS. 4–5 is a preferred embodiment, but different types of devices may be used to trap the twist-ties against the back wall according to the present invention. Alternatives to the illustrated cam member include other devices capable of moving laterally away from and toward the back wall or other devices for translating rotational motion into lateral motion. Preferably, the cam member 84 is stainless steel.

The top wall 92 may be configured to fit into a support base (not shown). For example, a support base could be used where two twist-tie dispensers 80 are held by the same support base, with the back walls 82 contacting each other. In the alternative, a support base may attach to the bottom wall 96 of one or two dispensers 80. Also other types of dispensers could be attached to the top wall or bottom wall of the dispenser. For example, a coupon dispenser could be attached to the bottom wall of the twist-tie dispenser where the twist-tie dispenser is used in a grocery store. A notch 102 at the juncture between the back wall 82 and the bottom wall 96 may accommodate attachment of a support base or additional dispenser, for example.

Holes (not shown) may be formed through the rear wall 82 to facilitate mounting of the dispenser 80 to a wall, to another support, or to another dispenser by means of screws or other fasteners. It will be appreciated that such holes may preferably be formed through rear wall 82 after the dispenser is formed.

A preferred dispenser may have a back wall about 5–6 inches wide and 5–6 inches high, most preferably 5.25 inches wide and 5.25 inches high. The depth of the preferred dispenser may be about 1.75 inches. However, where a larger twist-tie or flag twist-tie is used to accommodate writing on the twist-tie, the dispenser may be about seven inches high in one embodiment.

The present invention also provides methods of arranging twist-ties into clusters. In one such method, a sheet of twist-ties has parallel wires disposed within a carrier material. The wires are severed proximate first ends thereof, and the carrier material is cut between the parallel wires from second, opposite ends to where the wires are severed. The sheet back is preferably sized according to the width of the dispenser 80, or may alternatively be folded against itself more than once at relatively equal intervals. In the latter case, the first ends of the wires on discrete folded back portions of the sheet are interconnected by an adhesive.

Another such method facilitates arrangement of twist-ties into a cluster at least three twist-ties across and at least three-twist ties deep. The twist-ties have a wire disposed within a carrier material and are arranged to extend generally parallel to one another. The twist-ties are interconnected at one end by an adhesive, and the wire of each twist-tie is severed proximate the interconnected end, so that a person can pull on an opposite, free end of any of the twist-ties to remove it from the cluster.

The twist-tie cluster, with or without the dispenser, provides a compact and cost effective arrangement of twist-ties suitable for presentation at a point of purchase. The twist-ties can be provided in relatively large quantities with relatively little inconvenience.

The present invention has been described with reference to preferred embodiments and applications. Yet the foregoing description will enable those skilled in the art to recognize additional embodiments and applications of and for the present invention. Accordingly, the scope of the present invention is to be limited only to the extent of the following claims.

We claim:

1. A twist-tie dispenser, comprising:

a back wall; and a cam member, the cam member comprising cam member ends defining a cam axis, the cam member under comprising an off-axis portion set off from the cam axis wherein the cam member rotates between a first position and a second position to trap a group of twist-ties between the back wall and the cam member in the second position.

2. The twist-tie dispenser of claim 1, further comprising a pair of opposing side walls, wherein the cam member extends between the opposing walls.

3. The twist-tie dispenser of claim 1 further comprising a top wall extending from the back wall.

4. The twist-tie dispenser of claim 1 further comprising a bottom wall extending from the back wall.

5. The twist-tie dispenser of claim 4 further comprising a mounting notch on the bottom wall for mounting the dispenser on a support base.

6. The twist-tie dispenser of claim 1, further comprising:

a plurality of twist-ties, each having a wire retained within a strip of material and extending from a first end to a second end, wherein a cut is made in each of said wires between said first end and said second end, thereby defining a first segment, extending between said first end and said cut, and a second segment, extending between said cut and said second end, wherein each of said first segments and corresponding said second segments remain connected to one another by at least one uncut portion of said material.

7. The twist-tie dispenser of claim 6, further comprising:

a connecting means for connecting said first segments of the twist-ties together to form a cluster.

8. The twist-tie dispenser of claim 6, wherein said cluster has a width and a depth, said cluster is at least three twist-ties deep and at least three twist-ties wide, and said first segments abut each other over the depth and the width of said cluster.

9. The twist-tie dispenser of claim 6, wherein the connecting means is adhesive.

10. The twist-tie dispenser of claim 1 further comprising a stop for supporting the cam member in the second position.

11. The twist-tie dispenser of claim 1 wherein the cam member comprises a lever portion for moving the cam member between the first and second position.

12. A method of dispensing twist-ties comprising:

inserting one end of a twist-tie cluster between a rotating cam member and a back wall of a twist-tie dispenser, wherein the rotating cam member includes a lever portion that protrudes from a wall of the dispenser and rotation of the lever portion moves a portion of the cam member closer to the back wall; and rotating the lever portion of the cam member to move the cam member closer to the back wall, thereby applying pressure to the twist-tie cluster and trapping the twist-tie cluster between the rotating cam member and the back wall of the twist-tie dispenser.

13. The method of claim 12 wherein the cam member is rotated between a first position and a second position, wherein the twist-tie cluster is trapped against the back wall of the dispenser when the cam member is in the second position.

14. A twist-tie dispenser comprising:

a support structure having a pair of opposing side walls, each wall defining an opening, and a back wall connecting the opposing side walls;

a cam member having an off-axis portion and extending through the openings in the opposing side walls, the cam member rotatable between a first position and a second position; and wherein a first distance is defined between the cam member and the back wall when the cam member is in the first position and a second distance is defined between the cam member and the back wall when the cam member is in the second position, the second distance being smaller than the first distance.

15. The twist-tie dispenser of claim 14 further comprising a twist-tie cluster, wherein the second distance is sized to trap one end of the twist-tie cluster.

* * * * *

UNITED STATES PATENT AND TRADEMARK OFFICE

CERTIFICATE OF CORRECTION

PATENT NO. : 6,217,500 B1
DATED : April 17, 2001
INVENTOR(S) : Helseth et al.

It is certified that error appears in the above-identified patent and that said Letters Patent is hereby corrected as shown below:

Title page,
Item [56], References Cited, U.S. PATENT DOCUMENTS: insert

| | | | |
|---|---|---|---|
| -- | 4,558,813 | 12/1985 | Richards |
| | 4,566,660 | 01/1986 | Anscher et al. |
| | 4,596,195 | 06/1986 | Wenger |
| | 4,621,732 | 11/1986 | Olson |
| | 4,673,324 | 06/1987 | Hanson et al. |
| | 4,758,022 | 07/1988 | Podosek et al. |
| | 4,815,610 | 03/1989 | Borick et al. -- |

Signed and Sealed this

Sixth Day of August, 2002

*Attest:*

*Attesting Officer*

JAMES E. ROGAN
*Director of the United States Patent and Trademark Office*